US010767638B2

(12) United States Patent
Avanzi

(10) Patent No.: US 10,767,638 B2
(45) Date of Patent: Sep. 8, 2020

(54) DOUBLE-CHAMBER PISTON PUMP FOR THE DISTRIBUTION OF FLUID PRODUCTS

(71) Applicant: Corob S.p.A., San Felice sul Panaro (IT)

(72) Inventor: Roberto Avanzi, Finale Emilia (IT)

(73) Assignee: Corob S.p.A., San Felice sul Panaro (IT)

( * ) Notice: Subject to any disclaimer, the term of this patent is extended or adjusted under 35 U.S.C. 154(b) by 85 days.

(21) Appl. No.: 15/547,395

(22) PCT Filed: Jan. 28, 2016

(86) PCT No.: PCT/IB2016/050434
§ 371 (c)(1),
(2) Date: Jul. 28, 2017

(87) PCT Pub. No.: WO2016/120822
PCT Pub. Date: Aug. 4, 2016

(65) Prior Publication Data

US 2018/0003164 A1 Jan. 4, 2018

(30) Foreign Application Priority Data

Jan. 28, 2015 (IT) ..... UD2015A0009

(51) Int. Cl.

| | |
|---|---|
| ***F04B 5/02*** | (2006.01) |
| ***F04B 13/00*** | (2006.01) |
| ***F04B 17/03*** | (2006.01) |
| ***F04B 53/10*** | (2006.01) |
| ***F04B 39/00*** | (2006.01) |
| *F04B 9/02* | (2006.01) |

(52) U.S. Cl.
CPC ..... *F04B 5/02* (2013.01); *F04B 13/00* (2013.01); *F04B 17/03* (2013.01); *F04B 39/0016* (2013.01); *F04B 53/10* (2013.01); *F04B 9/02* (2013.01); *F04B 53/108* (2013.01)

(58) Field of Classification Search
CPC ..... F04B 13/00; F04B 17/03; F04B 35/04; F04B 7/0266; F04B 1/12; F04B 1/14; F04B 1/182
See application file for complete search history.

(56) References Cited

U.S. PATENT DOCUMENTS 1,498,471 A 6/1924 Miller
2,368,013 A 1/1945 Ford
(Continued)

FOREIGN PATENT DOCUMENTS

GB 1 522 552 A 8/1978

OTHER PUBLICATIONS

International Search Report and Written Opinion from corresponding International Application No. PCT/IB2016/050434 dated Apr. 25, 2016; (8 pp).

*Primary Examiner* — Charles G Freay
*Assistant Examiner* — Thomas Fink
(74) *Attorney, Agent, or Firm* — Calderone Bullock LLC

(57) ABSTRACT

A piston pump is disclosed suitable to be installed on machines for dispensing fluid products, comprising a jacket, a piston device mobile with alternate motion inside said jacket and comprising a rod and a head. The pump also comprises a pipe for fluids to enter and a pipe for fluids to exit, said pipes being disposed on the same side of the jacket and on opposite sides with respect to the piston device.

7 Claims, 2 Drawing Sheets

(56) References Cited

U.S. PATENT DOCUMENTS

| | | | | |
|---|---|---|---|---|
| 3,658,387 | A * | 4/1972 | Roper | B60T 13/10 303/10 |
| 4,008,012 | A * | 2/1977 | Page | F04B 3/00 417/435 |
| 4,137,913 | A * | 2/1979 | Georgi | A61M 5/14216 128/DIG. 12 |
| 4,151,447 | A * | 4/1979 | von der Heide | H02K 41/031 104/290 |
| 4,211,345 | A * | 7/1980 | Taubenmann | B01F 15/0237 222/134 |
| 5,156,537 | A | 10/1992 | Massinon | |
| 7,074,020 | B2 * | 7/2006 | Navarro | F04B 7/02 137/542 |
| 8,191,733 | B2 | 6/2012 | Seppänen | |
| 2001/0023881 | A1 * | 9/2001 | Magri | B67D 1/0085 222/504 |
| 2002/0197173 | A1 * | 12/2002 | Ogawa | F04B 13/00 417/413.1 |
| 2004/0178763 | A1 * | 9/2004 | Kuwano | H02P 8/14 318/685 |
| 2011/0259918 | A1 | 10/2011 | Meeuwisse | |

* cited by examiner

DOUBLE-CHAMBER PISTON PUMP FOR THE DISTRIBUTION OF FLUID PRODUCTS

BACKGROUND OF THE INVENTION

Field of the Invention

The present invention concerns a piston pump for the distribution of fluid products such as, for example, colorant liquids, paint bases, varnishes, enamels, inks and suchlike, located inside containers installed on dispensing or distribution machines of fluid products. In particular, the invention concerns a piston pump characterized by particular geometric solutions that allow to obtain an improvement in the delivery performances of the fluid product at least in terms of precision and repeatability.

Description of Related Art

Machines are known for dispensing or distributing fluid products, such as for example colorants with different tones or hues, able to be mixed with each other and/or added to a base substance in order to create a varnish or paint of a determinate color.

Known machines normally comprise a plurality of containers containing a determinate colorant, able to be selectively connected to one or more delivery nozzles and connected to respective pump means that cause the selective delivery of the fluid product in a suitably chosen quantity, with the help of an electronic processor for example.

It is known that to obtain accuracy and repeatability of the doses of dyes to be mixed it is fundamental to make a suitable choice of the pump mean.

It is known that, among pump means used to deliver fluid products, volumetric pumps of the piston type are used, with a single chamber, or a double chamber.

It is also known that single-chamber volumetric piston pumps are characterized by a single work chamber with a well-defined volume. The volume is determined by the travel effected by the piston and by the diameter of the chamber itself, and the sizes are defined on the basis of the requisites that a dispensing machine must satisfy. For example, the requisites can include delivery time, delivery flow, delivery quantity, not to mention the bulk.

Moreover, a single-chamber volumetric piston pump, because of how it is configured, is simple to make, compared to a double-chamber piston pump, and also entails a simplicity of the hydraulic circuit connected to it.

One disadvantage of the application of a single-chamber piston pump is the long delivery times of the fluid product. Indeed a single-chamber volumetric piston pump provides a suction step of the fluid product from the container inside the chamber itself. This step represents a waiting time, that is, a non-delivery time, which lasts from the activation step of the pump until the complete filling of the chamber, that is, when the piston reaches its end-of-travel. The delivery begins in the distribution step, that is, when the piston inverts its travel and delivers the fluid product from the pump chamber to the final container (for example, a can, a bottle, or a jerry can).

It is also known that the piston pumps with two chambers at least partly solve the disadvantage of long delivery times. In fact, alternating the chambers involved by the suction and delivery steps allows a substantial operative continuity without downtimes. Therefore, with a double-chamber piston pump there is an appreciable optimization of the delivery times of the fluid product.

The U.S. Pat. No. 8,191,733 B2 describes a double-chamber piston pump, in which the small plate of the piston comprises a non-return valve disposed advantageously in the direction of the delivery flow. The non-return valve thus disposed allows a simultaneous suction and distribution process, as well as determining a substantially linear travel of the hydraulic circuit. Moreover, the two chambers of the piston pump have different sizes from each other since the second chamber, comprised between the piston and the second end-of-travel, has a smaller volume than the first by a volume equal to the volume occupied by the piston rod. This difference in volume, in cooperation with the non-return valve comprised inside the piston, allows the fluid product to flow in the delivery direction.

The concept of a different volume between two chambers of a piston pump is also applied in patent US 2011/0259918 A1, but in different embodiments. In particular, a non-return valve comprised in the piston is not provided. This absence is compensated by a different hydraulic circuit that provides two non-return valves during suction and therefore two distinct entrances in the piston pump, one for each of the two chambers. During delivery, two non-return valves are always provided corresponding to two different exits from the piston pump, one for each of the two chambers. The principle that governs the flow of the fluid product from a suction pipe to a delivery pipe is based on the alternate movement of the piston inside the central pumping pipe.

The solution of US 2011/0259918 provides the entrance of the fluid in a position opposite the exit. Therefore, this solution cannot be used in all the cases in which, for structural reasons for example, the entrance must be positioned on the same side as the exit, that is, so that the entrance and exit pipes are parallel to each other and with the entrance and exit facing in the same direction.

Moreover, the solution of US 2011/0259918 provides long travels of the pistons and an asymmetrical disposition and behavior thereof.

Document U.S. Pat. No. 5,156,537 (US'537) describes a pumping device to separate, inside the same device, the liquid and gas components of the fluid to be delivered.

In this case, the shaft on which the head of the piston of the pump is moved is present in only one of the two chambers and this determines a difference in volume of the two delivery chambers. This difference in volume determines poor accuracy in the dosage of the fluid products, which is not however required in US'537 given the large quantities of fluid moved at each pumping cycle, and poor repeatability in the dosage of the fluid. Moreover, this difference in volume also determines a different duration of the suction and delivery steps of the fluid product into and from the two chambers. This causes an asymmetry in the delivery and suction times from which ensue time intervals in which the fluid product is not delivered.

Document U.S. Pat. No. 4,008,012 describes a pumping device for food products with two chambers, where the upper chamber, having part of its volume occupied by the end-of-travel mechanisms, has a smaller volume than the lower chamber.

Documents U.S. Pat. Nos. 2,368,013, 1,498,471 and GB 1522552 describe other pumping devices which have the same problems as those described in the cited known documents, that is, a difference in volume between the two chambers and a consequent asymmetry in the delivery and suction times.

BRIEF SUMMARY OF THE INVENTION

One purpose of the present invention is to make a piston pump that allows high levels of accuracy and repeatability of the doses.

It is also a purpose of the present invention to make a double-chamber piston pump that allows to keep the durations of the suction and delivery steps of the fluid equal in the two chambers without time intervals during which the fluid is not delivered.

Another purpose of the present invention is to make a double-chamber piston pump that allows to simplify the control of the doses to be carried out.

Another purpose of the present invention is to make a double-chamber piston pump that provides rapid delivery times, even for large quantities of fluid product, but without increasing the sizes of the piston pump and therefore increasing its bulk.

The Applicant has devised, tested and embodied the present invention to overcome the shortcomings of the state of the art and to obtain these and other purposes and advantages.

The present invention is set forth and characterized in the independent claim, while the dependent claims describe other characteristics of the invention or variants to the main inventive idea.

In accordance with the above purposes, a double-chamber piston pump according to the present invention, suitable to be installed in stations for the delivery of fluid products, comprises a hollow body divided into two chambers by a piston device so that said two chambers have the same volume.

According to a first characteristic of the present invention, the two chambers are respectively defined by the position of the head of the piston device, on the respective opposite sides thereof, and are alternatively operating in suction and in delivery thanks to the alternate drive of respective suction and delivery valves, disposed symmetrically at the sides of the shaft of the piston device.

In a preferred formulation of the invention, the shaft of the piston device defines the longitudinal median axis of the piston pump.

According to the present invention, the installation diagram of the valves with respect to the body of the piston pump can be described as an anti-parallel disposition.

In a preferred formulation, the piston device is actuated by a high-resolution step motor.

The piston device comprises, as we said, a head and a rod. In an advantageous embodiment, the head is made of a plastic or metal material, resistant to friction forces and to the temperatures that are generated during the delivery activity.

The double-chamber piston pump, according to the present invention, is configured with sizes studied specifically to be able to carry out deliveries of big and small quantities of fluid product, at the same time maintaining high levels of accuracy and repeatability of the doses. Therefore, the hollow body will have sizes suitable to convey an adequate flow of fluid product. In particular, the sizing of the bore of the hollow body is dependent on the performances of the pump and is decisive for the definition of the diameter of the rod.

In accordance with another characteristic of the present invention, the valves are of the one-way or non-return type. The valves are comprised in an entrance and exit device, each in correspondence to an entrance or exit aperture, and are installed so as to assist the direction of flow of the fluid product.

According to one characteristic of the present invention, the introduction pipe of the fluid material inside the chambers of the pump and the delivery pipe of the fluid material are on the same side of the pump.

According to another characteristic, said pipes develop substantially parallel to each other and substantially parallel to the rod of the piston.

According to another characteristic, the suction and delivery valves connected with a first chamber of the piston are disposed, one with respect to the other, on opposite sides with respect to the median axis of the body of the pump, while the suction and delivery valves connected with the other, second chamber of the piston are symmetrical and specular with respect to the valves of the first chamber.

During functioning, the suction valve associated with the first chamber and the delivery valve associated with the second chamber are open at the same time during a first travel of the piston in a first direction, while the delivery valve associated with the first chamber and the suction valve associated with the second chamber are open at the same time during a second travel of the piston in a second direction, opposite the first direction.

The double-chamber piston pump allows the suction and distribution steps of the fluid product to be performed simultaneously. Indeed, while one chamber is affected by a positive distribution flow, the other chamber has an equal and negative suction flow.

Another purpose of the present invention is to define a dispensing process of the fluid products that allows the suction and distribution condition to be carried out simultaneously in the two chambers of the piston pump. In particular, one step consists in sliding the piston device from a lower end of the hollow body to an upper end of the hollow body; the other step, on the other hand, consists in sliding the piston device from the upper end to the lower one. In their turn, the valves will be opened and closed according to the logic of anti-parallel distribution. When a chamber is in the suction condition, the entrance valve is open to allow the entrance of the fluid product into the chamber and to prevent its exit with the exit valve closed. On the contrary, when the chamber is in a distribution condition the exit valve will be open to facilitate the exit of the fluid product from the chamber and the entrance valve will be closed to prevent the flow from flowing backward.

BRIEF DESCRIPTION OF THE SEVERAL VIEWS OF THE DRAWINGS

These and other characteristics of the present invention will become apparent from the following description of some embodiments, given as a non-restrictive example with reference to the attached drawings wherein.

DETAILED DESCRIPTION OF THE INVENTION

Figure 2:
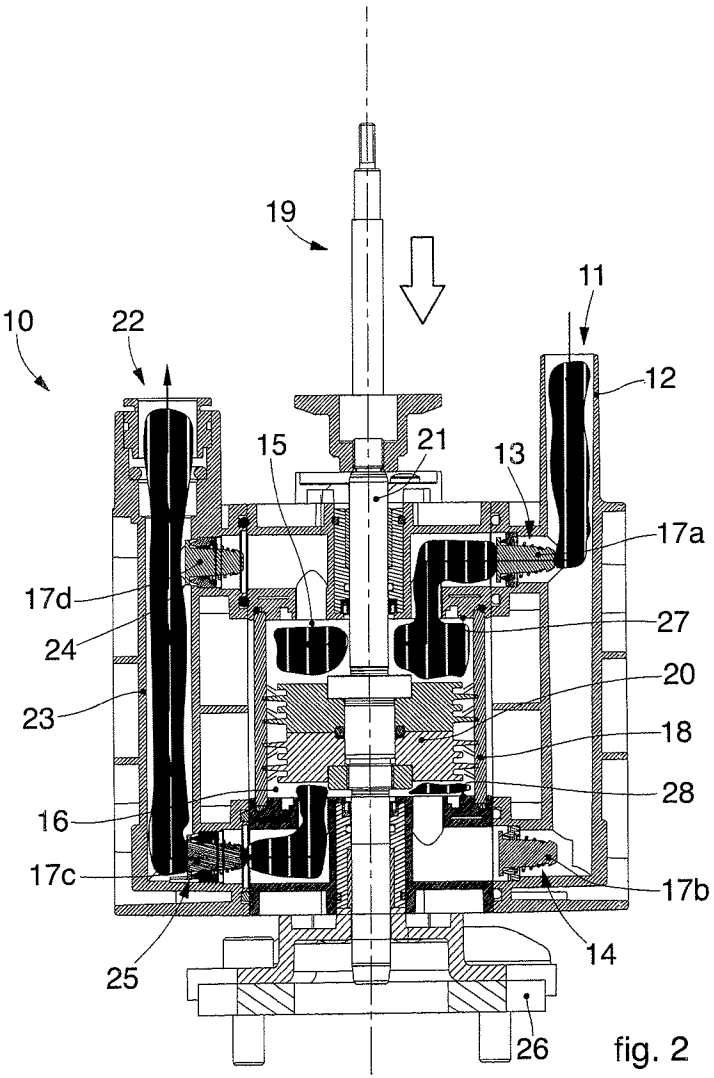
FIG. 2 is a section view of the piston pump during a functioning step.

To facilitate comprehension, the same reference numbers have been used, where possible, to identify identical common elements in the drawings. It is understood that elements and characteristics of one embodiment can conveniently be incorporated into other embodiments without further clarifications.

We shall now refer in detail to the various embodiments of the present invention, of which one or more examples are shown in the attached drawing. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Figure 1:
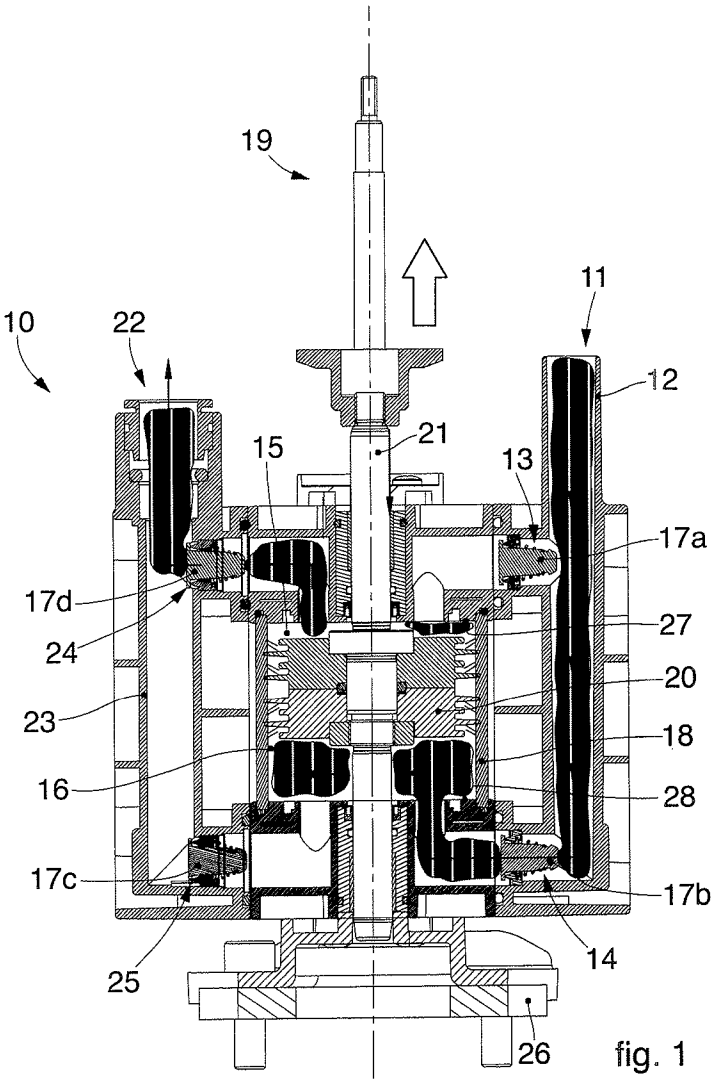
FIG. 1 is a section view of the piston pump during a functioning step.
Figure 4:
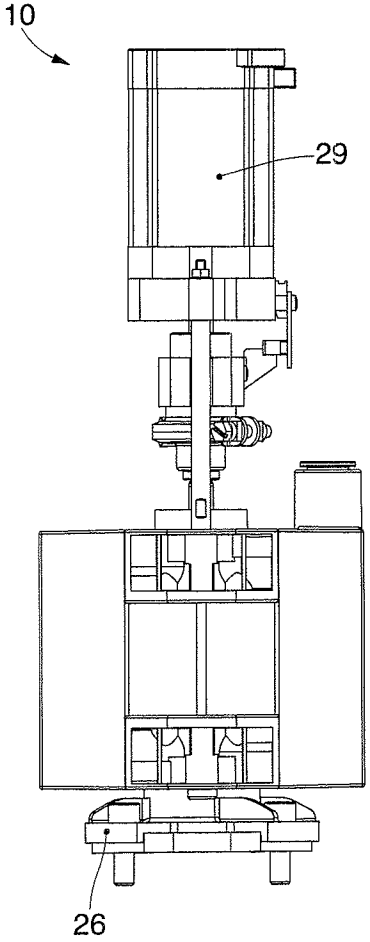
FIG. 4 is is a view of the piston pump with the motor.

In accordance with the embodiments of FIGS. 1, 2 and 4, the invention concerns a double-chamber piston pump 10, hereafter simply called piston pump, installed on machines for dispensing fluid products.

Hereafter in the description, merely by way of non-restrictive example, the fluid product is indicated as a dye, but it can be any other colorant liquid, such as for example a paint base, enamel, an ink or suchlike.

The piston pump 10 comprises an entrance device 11 able to connect the piston pump 10 to the container (not shown in the drawings) that contains the dye.

The entrance device 11 comprises an entrance pipe 12 that connects the container of the dye to the piston pump 10. The entrance pipe 12 can divide into two distinct entrances, an upper 13 and a lower 14, which allow the dye to enter respectively into an upper 15 and a lower 16 chamber during the suction step in each chamber.

The chambers 15 and 16 are here defined upper and lower with reference to the drawing, though this definition is intended merely for ease of illustration.

Each entrance can comprise a one-way or non-return valve 17, installed so as to promote the flow of the dye in the distribution direction, avoiding possible flows in the opposite direction.

The valves are defined here as 17*a*, 17*b*, 17*c*, 17*d*. In particular, as will be described in more detail hereafter, the valves 17*a* and 17*d* are respectively the suction and delivery valves connected to the first upper chamber 15, while the valves 17*b* and 17*c* are respectively the suction and delivery valves connected to the second lower chamber 16. As can be seen in the drawings, the valves 17*a*, 17*d*, connected to the first upper chamber 15, are disposed on opposite sides with respect to the median axis of the pump and specular and symmetrical with respect to the corresponding valves 17*b*, 17*c* connected to the second lower chamber 16.

The internal mechanism of the piston pump 10 comprises a jacket 18, configured as a hollow body.

The jacket 18 comprises an upper end-of-travel 27 and a lower end-of-travel 28.

In a particular embodiment, the jacket 18 is configured so as to have a bore that goes from 35 mm to 45 mm, preferably 40 mm, or from 50 mm to 60 mm, preferably 54 mm.

The piston pump 10 comprises a piston device 19 that slides inside the jacket 18 and allows to achieve the alternate steps of suction and distribution of the dye.

The jacket 18 can be made of stainless steel, or of technical ceramic, or any other metal or material resistant to the forces and other stresses that are generated inside during functioning.

The piston device 19 comprises a head 20 with sizes complimentary to the bore of the jacket 18 and such as to allow the piston device 19 to slide inside it.

The head 20 can be made of a plastic material resistant to the forces and temperatures that originate from mechanical sliding, for example PTFE (polytetrafluoroethylene), or other suitable material.

The head 20 of the piston device 19 defines, respectively above and below it, the two chambers 15 and 16 of the piston pump 10 that contain the same volume of the fluid product.

This structure allows to alternately deliver always the same quantity of fluid, independently from the chamber 15 or 16, inside which the fluid product is taken in.

The piston device 19 also comprises a rod 21 firmly connected at one end to the head 20, while the remaining end is connected to a high-resolution step motor 29.

The rod 21 can be made of a material resistant to the stresses occurring during the drive of the motor 29, for example stainless steel or an aluminum alloy.

In a particular embodiment, the rod 21 can be configured so that the ratio between its cross section and the section of the bore of the jacket 18 is no higher than 0.25.

The piston device 19, during functioning, slides inside the jacket 18 from the upper end-of-travel 27 to the lower end-of travel 28 and vice versa. The volumes of the upper 15 and lower 16 chambers are equal to each other and depend on the bore of the jacket 18, and also vary during the travel of the piston device 19.

In a particular embodiment, the travel of the piston device 19 has a length from about 10 mm to about 15 mm, preferably 12 mm. Therefore the maximum volume of both the chambers 15 and 16 is given by the volume of the jacket 18 minus the bulk volume of the same portion of the head 20 and the rod 21.

The piston pump 10 comprises an exit device 22 able to allow the exit of the dye from the jacket 18 and thus to direct the dye toward the final distribution elements (not shown in the drawings) of the dispensing machine.

The exit device 22 can comprise an exit pipe 23 comprising two exits, respectively an upper exit 24 and a lower exit 25, each of which can comprise a one-way or non-return valve 17, respectively 17*d* and 17*c*, disposed so as to assist the flow of dye exiting from the two chambers 15 and 16.

It should be noted that the axial-symmetrical and specular position of the valves 17*a*, 17*b*, 17*c* and 17*d* defines the positions of the exits 24 and 25 at the same height as the entrances 13 and 14, rendering the flows of the two chambers 15 and 16 coherent and homogenous with respect to each other.

Moreover, the entrance pipe 12 and the exit pipe 23 are advantageously disposed on the same side of the piston pump 10, they are parallel to each other and end substantially at the same height, thus promoting the assembly of the piston pump 10 into a dispensing machine for fluid products.

The piston pump 10 can comprise a support 26 that can be attached to a surface of the dispensing machine for fluid products.

This support 26 allows to be able to use the piston pump 10 in any orientation, keeping the orientation of the entrance pipe 12 and the exit pipe 23 always in a common direction.

Always with reference to FIGS. 1 and 2, the functioning of the piston pump 10 can be schematically synthesized in two principal steps distinguished by the direction of movement of the piston device 19.

A first step consists in sliding the piston device 19 from the lower end-of-travel 28 to the upper end-of-travel 27 of the jacket 18, that is, upward as shown in FIG. 1. The first upper chamber 15 is in delivery mode with the valve 17*a* of the upper entrance 13 closed and the valve 17*d* of the upper exit 24 open. At the same time, the second lower chamber 16 is in suction mode with the valve 17*b* of the lower entrance 14 open and the valve 17*c* of the lower exit 25 closed.

Once the piston device 19 has reached the upper end-of-travel 27, it inverts the sliding direction in the direction of the lower end-of-travel 28, that is, it moves downward as shown in FIG. 2. The first upper chamber 18 is in suction mode with the valve 17*a* of the upper entrance 13 open and the valve 17*d* of the upper exit 24 closed. At the same time, the second lower chamber 16 is in delivery mode with the valve 17*b* of the lower entrance 14 closed and the valve 17*c* of the lower exit 25 open.

Functioning this way is allowed with the configuration of the valves 17 in anti-parallel.

The functioning of the piston pump 10 can be summarized as simultaneous suction and distribution steps that last the same length of time and through which the same quantity of dye flows.

The simultaneous nature of the suction and delivery steps of the dye is given by the presence of two chambers inside the jacket 18.

Figure 3:
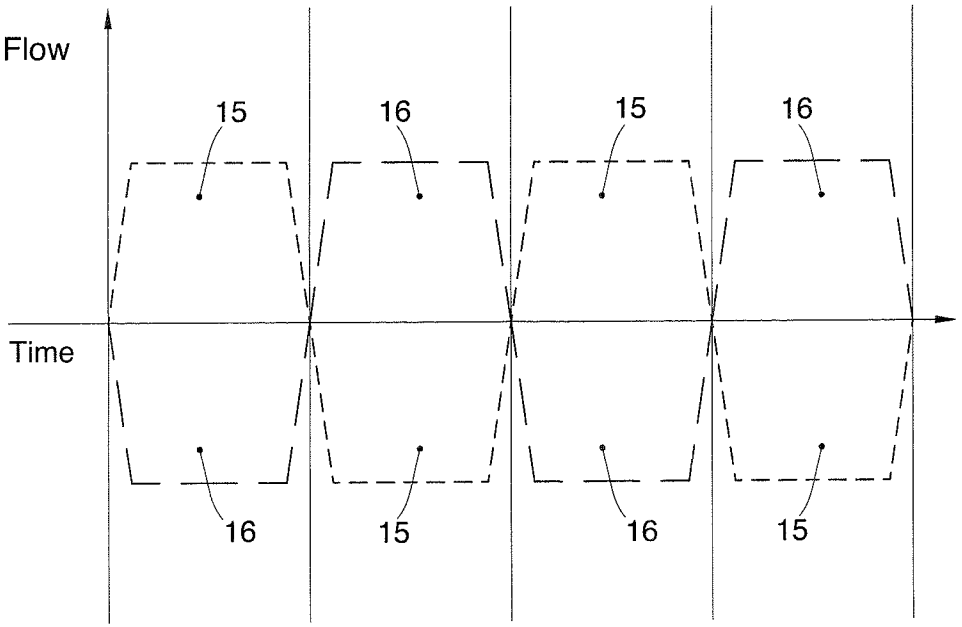
FIG. 3 is a graph of the progress of the flow.

Moreover, according to an embodiment previously described and with reference to FIG. 3, the volume of the two chambers 15 and 16 allows to have, inside the jacket 18, in normal working conditions, one chamber through which a flow with a positive sign passes (distribution step) and the other chamber through which an equal flow and with the opposite sign passes (suction step). Therefore, the fact that the upper 15 and lower 16 chambers have the same volume allows to improve the accuracy and repeatability of the doses, provided that this aspect is combined with the high-resolution actuation exerted by the step motor 29 controlled in position and in current by suitable sensors. This embodiment allows to achieve a simplified control of the doses by the electronic processor, in particular for very low quantities delivered (most critical condition).

According to the illustration in FIG. 3, providing two chambers with equal volume means obtaining equal suction and delivery times and this also means having an inversion of the steps in the two chambers 15, 16 at the same moment, guaranteeing the continuity of the delivery process.

The embodiments described above allow to make a double-chamber piston pump 10 able to deliver a quantity of dye in a short time thanks to the double-chamber system and to the geometric characteristics of the mechanical system that allows a flow of dye delivered that goes from 0.371 l/min to 1.639 l/min, preferably 0.582 l/min, or 1.094 l/min.

It is clear that modifications and/or additions of parts may be made to the double-chamber piston pump for fluid products as described heretofore, without departing from the field and scope of the present invention.

It is also clear that, although the present invention has been described with reference to some specific examples, a person of skill in the art shall certainly be able to achieve many other equivalent forms of double-chamber piston pump for fluid products, having the characteristics as set forth in the claims and hence all coming within the field of protection defined thereby.

I claim:

1. A piston pump suitable to be installed on a machine for dispensing fluid products, comprising a jacket, a piston device mobile with alternate motion inside said jacket and comprising a rod having a central axis and a head, the pump also comprising an entrance device comprising an entrance pipe, the entrance pipe for connecting the piston pump to a container for a fluid product, and an exit device comprising an exit pipe for allowing exit of the fluid product from the jacket, the exit device for directing the fluid product toward a dispensing machine, said entrance and exit pipes being disposed on a first axial end of the jacket and at opposite positions radially with respect to said central axis, wherein the piston pump comprises a support positioned on an opposite, second axial end of the jacket from the entrance device and the exit device, the support configured to associate said piston pump structurally with a dispensing machine for fluid products allowing use of the piston pump in any orientation while keeping the orientation of the entrance and exit pipes oriented in a common direction;

wherein the piston pump comprises a first and a second chamber each with the same containing volume for said fluid product, said first and second chambers being defined on opposite sides of said head of the piston device, each of said chambers being connected to said entrance and exit pipes by means of a respective suction valve and a respective delivery valve, wherein the suction valve and the delivery valve connected to the first chamber and the second chamber are disposed at opposite positions radially with respect to said central axis, and the suction valve and the delivery valve connected to the first chamber are each disposed at the same axial position, and the suction valve and the delivery valve connected to the second chamber are each disposed at the same axial position, wherein during alternating motion of the piston device, a stream of a fluid product sucked into the first chamber is equal in quantity with respect to a stream of the fluid product delivered by the second chamber and a stream of a fluid product delivered by the first chamber is equal in quantity with respect to a stream of the fluid product sucked into the second chamber at a given instant in time, and wherein said entrance pipe and said exit pipe are parallel to each other and substantially end at the same axial position near the first axial end; and wherein said entrance pipe divides into two distinct entrances, a first and a second entrance corresponding to the first and the second chambers respectively, which allow the fluid product to enter respectively into said first and second chambers during the suction step in each chamber and each entrance comprises one of said suction valves, installed so as to promote flow of the fluid product into the respective chamber, avoiding possible flows in an opposite direction; wherein said exit pipe comprises two exits, respectively a first and a second exit, each of which comprises one of said delivery valves disposed so as to assist the flow of fluid product exiting from said two chambers; and a step motor driving said piston device in said alternate motion, said step motor disposed at the first axial end of said jacket with respect to the support.

2. The piston pump as in claim 1, wherein said jacket is configured so as to have a bore that goes from 35 mm to 45 mm, or from 50 mm to 60 mm.

3. The piston pump as in claim 1, wherein said rod has a diameter with respect to the bore of the jacket with a ratio of no higher than 0.25.

4. The piston pump as in claim 1, wherein the piston device has a travel inside said jacket that goes from 10 mm to 15 mm.

5. The piston pump as in claim 1, wherein said head is made of PTFE.

6. The piston pump as in claim 1, wherein said piston device is driven by a high-resolution step motor.

7. A method for dispensing fluid products using a piston pump as in claim 1, comprising a first step that provides sliding of the piston device from a lower end-of-travel to an upper end-of-travel, wherein the suction valve of the first chamber and the delivery valve of the second chamber are closed and the suction valve of the second chamber and the delivery valve of the first chamber are open; and a second step that provides sliding of the piston device from said upper end-of-travel to said lower end-of-travel wherein the suction valve of the first chamber and the delivery valve of the second chamber are open, and the suction valve of the second chamber and the delivery valve of the first chamber are closed, wherein the duration times of the suction and delivery steps that occur simultaneously in said chambers are equal, and the same quantity of said fluid product passes through said chambers, wherein inversion of the steps occurs at the same moment, and wherein the entrance and exit of fluid product from the piston pump occur on the axial end of the jacket and in directions substantially parallel to each other.

* * * * *